US010937364B2

(12) United States Patent
Seo et al.

(10) Patent No.: US 10,937,364 B2
(45) Date of Patent: Mar. 2, 2021

(54) DISPLAY DEVICE AND DRIVING METHOD THEREOF

(71) Applicant: Samsung Display Co., Ltd., Yongin-si (KR)

(72) Inventors: Young Wan Seo, Yongin-si (KR); Min Kyu Woo, Yongin-si (KR); Cheol Gon Lee, Yongin-si (KR); Mee Hye Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/597,771

(22) Filed: Oct. 9, 2019

(65) Prior Publication Data

US 2020/0273402 A1 Aug. 27, 2020

(30) Foreign Application Priority Data

Feb. 26, 2019 (KR) ..... 10-2019-0022469

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01); *G09G 2320/043* (2013.01)

(58) Field of Classification Search
CPC ..... G09G 3/3233
See application file for complete search history.

(56) References Cited

U.S. PATENT DOCUMENTS

| | | | | |
|---|---|---|---|---|
| 9,978,311 | B2 | 5/2018 | Hwang et al. | |
| 2005/0057459 | A1* | 3/2005 | Miyazawa | G09G 3/3233 345/76 |
| 2005/0083270 | A1* | 4/2005 | Miyazawa | G09G 3/3233 345/76 |
| 2008/0186301 | A1* | 8/2008 | Park | G09G 3/3233 345/211 |
| 2011/0254871 | A1* | 10/2011 | Yoo | G09G 3/3233 345/690 |
| 2013/0222356 | A1* | 8/2013 | Jeong | G09G 3/3233 345/211 |
| 2014/0354711 | A1* | 12/2014 | In | G09G 3/3233 345/691 |

(Continued)

FOREIGN PATENT DOCUMENTS

| | | | |
|---|---|---|---|
| KR | 10-2018-0091985 | A1 | 8/2018 |
| KR | 10-2018-0093147 | A | 8/2018 |

*Primary Examiner* — William Boddie
*Assistant Examiner* — Andrew B Schnirel
(74) *Attorney, Agent, or Firm* — Lewis Roca Rothgerber Christie LLP

(57) ABSTRACT

A display device includes a plurality of pixels, each of the pixels including an organic light emitting diode and a plurality of transistors configured to control a current applied to the organic light emitting diode, wherein an aging frame includes an aging period in which at least one of the plurality of transistors is aged, wherein at least one of the plurality of transistors is in a turn-off state in the aging period, and wherein a potential difference between one electrode and an other electrode of a transistor of the plurality of transistors is equal to or greater than a reference potential difference, the reference potential difference being a difference value between a high level and a low level of a first power source voltage.

25 Claims, 11 Drawing Sheets

(56) References Cited

U.S. PATENT DOCUMENTS

| | | | | |
|---|---|---|---|---|
| 2016/0203759 | A1* | 7/2016 | Han | G09G 3/3233<br>345/212 |
| 2018/0226023 | A1 | 8/2018 | Park et al. | |
| 2018/0226028 | A1 | 8/2018 | Park et al. | |
| 2020/0090587 | A1* | 3/2020 | Seo | G09G 3/3291 |

* cited by examiner

DISPLAY DEVICE AND DRIVING METHOD THEREOF

CROSS-REFERENCE TO RELATED APPLICATION

The application claims priority to and the benefit of Korean Patent Application No. 10-2019-0022469, filed Feb. 26, 2019, the entire content of which is hereby expressly incorporated by reference.

BACKGROUND

1. Field

Aspects of the present invention relate to a display device and a driving method thereof.

2. Discussion

With the development of information technology, the importance of display devices, which are a connection medium between users and information, has become ever more apparent. In response to this, the use of display devices such as liquid crystal display devices, organic light emitting display devices, and plasma display devices has been increasing.

The display device may include a display panel for displaying an image, and the display panel may include a plurality of pixels, which are minimum units for displaying the image. Each of the plurality of pixels may include a pixel circuit, and the pixel circuit may include a plurality of transistors. If an off-current increases when a transistor is in a turn-off state, the pixel may emit light at an undesired point of time, and thus, a problem such as a mura defect may occur in the display panel.

SUMMARY

Aspects of embodiments of the present invention are directed to a display device and a driving method thereof capable of aging a switching transistor and an initialization transistor of each pixel before an image is displayed in order to reduce an off-current of the transistor and to prevent or substantially reduce the incidence of a dark spot or a mura defect that may occur at a low grayscale of the display device.

Aspects of embodiments of the present invention are directed to a display device and a driving method thereof capable of aging an initialization transistor and a driving transistor of each pixel before an image is displayed in order to reduce an off-current of the transistor and to improve characteristics of the transistor.

According to some embodiments of the present invention, there is provided a display device including: a plurality of pixels, each of the pixels including: an organic light emitting diode; and a plurality of transistors configured to control a current applied to the organic light emitting diode, wherein an aging frame includes an aging period in which at least one of the plurality of transistors is aged, wherein at least one of the plurality of transistors is in a turn-off state in the aging period, and wherein a potential difference between one electrode and an other electrode of a transistor of the plurality of transistors is equal to or greater than a reference potential difference, the reference potential difference being a difference value between a high level and a low level of a first power source voltage.

In some embodiments, the plurality of transistors include: a first transistor including a gate electrode connected to a first node, an electrode connected to a first power source voltage line, and an other electrode connected to a second node; a second transistor including a gate electrode connected to a scan line, an electrode connected to the first node, and an other electrode connected to a third node; and a third transistor including a gate electrode connected to a second control line, one electrode connected to the third node, and the other electrode connected to the second node, wherein each of the pixels includes: a first capacitor having one electrode connected to the first node and an other electrode connected to a first control line; and a second capacitor having one electrode connected to the third node and an other electrode connected to a data line, and wherein the organic light emitting diode includes: an anode electrode connected to the second node; and a cathode electrode connected to a second power source voltage line.

In some embodiments, the aging period includes a first aging period for aging the second transistor and the third transistor, and in the first aging period: a scan signal applied to the scan line is maintained at a turn-off level to turn off the second transistor, a second control signal applied to the second control line is maintained at the turn-off level to turn off the third transistor, and a data voltage applied to the data line is changed from the high level to the low level at a time of the first aging period.

In some embodiments, a difference value between the high level and the low level of the data voltage is greater than that between the high level and the low level of the first power source voltage.

In some embodiments, the first aging period includes: a first period in which a first control signal applied to the first control line is at the low level, the first power source voltage applied to the first power source voltage line is at the low level, and a second power source voltage applied to the second power source voltage line is at the high level; and a second period in which the first control signal is at the high level, the first power source voltage is at the high level, and the second power source voltage is at the low level.

In some embodiments, the aging period includes a second aging period for aging the first transistor and the third transistor, and the second aging period includes: a first period in which a first control signal applied to the first control line is at the low level, the first power source voltage applied to the first power source voltage line is at the low level, and a second power source voltage applied to the second power source voltage line is at the high level; and a second period in which the first control signal is at the high level, the first power source voltage is at the high level, and the second power source voltage is at the low level.

In some embodiments, the third transistor is aged in the first period and the second period, and the first transistor is aged in the second period.

In some embodiments, a difference value between the high level and the low level of a data voltage in the second aging period is smaller than that between the high level and the low level of the first power source voltage.

In some embodiments, the aging frame further includes a third period before the second aging period, and in the third period, a scan signal having a turn-on level is sequentially applied to a plurality of scan lines connected to the plurality of pixels, and a data voltage applied to a plurality of data lines connected to the plurality of pixels is at the high level.

In some embodiments, in the third period, scan signals having a turn-on level are concurrently applied to the plurality of scan lines.

In some embodiments, in an on-bias period, a first control signal applied to the first control line is at the low level, and the first transistor is in a turn-on state.

In some embodiments, in a first initialization period, the first power source voltage applied to the first power source voltage line is at the low level, a first control signal applied to the first control line is at the low level, a second control signal applied to the second control line is at a turn-on level, and a scan signal applied to the scan line is at a turn-off level, and in a second initialization period, the first power source voltage is at the low level, the first control signal is at the high level, the second control signal is at the turn-on level, and the scan signal is at the turn-on level.

In some embodiments, in a compensation period, the first power source voltage applied to the first power source voltage line is at the high level, a first control signal applied to the first control line is at the high level, a second control signal applied to the second control line is at a turn-on level, and a scan signal applied to the scan line is at the turn-on level.

In some embodiments, the aging frame is different from an image frame and the plurality of pixels do not emit light during the aging frame.

In some embodiments, the aging frame is repeated one or more times before an image frame.

According to some embodiments of the present invention, there is provided a driving method of a display device including a plurality of pixels, each of the pixels including an organic light emitting diode and a plurality of transistors for controlling a current applied to the organic light emitting diode, the method including: aging at least one of the plurality of transistors in an aging period, wherein in the aging period, at least one of the plurality of transistors is in a turn-off state, a potential difference between one electrode and an other electrode of at least one of the plurality of transistors is equal to or greater than a reference potential difference, and the reference potential difference is a difference value between a high level and a low level of a first power source voltage.

In some embodiments, the transistors include: a first transistor having a gate electrode connected to a first node, one electrode connected to a first power source voltage line, and an other electrode connected to a second node; a second transistor having a gate electrode connected to a scan line, one electrode connected to the first node, and an other electrode connected to a third node; and a third transistor having a gate electrode connected to a second control line, one electrode connected to the third node, and an other electrode connected to the second node, wherein each of the pixels includes: a first capacitor having one electrode connected to the first node and an other electrode connected to a first control line; and a second capacitor having one electrode connected to the third node and an other electrode connected to a data line, and wherein the organic light emitting diode includes: an anode electrode connected to the second node; and a cathode electrode connected to a second power source voltage line.

In some embodiments, the aging at least one of the transistors includes: aging the first transistor and the second transistor in a first aging period by applying a scan signal having a turn-off level to the scan line to turn off the second transistor, applying a second control signal having the turn-off level to the second control line to turn off the third transistor, and changing a data voltage applied to the data line from the high level to the low level.

In some embodiments, a difference value between the high level and the low level of the data voltage is greater than that between the high level and the low level of the first power source voltage.

In some embodiments, the first aging period includes: applying a first control signal having the low level to the first control line, applying the first control signal having the low level to the first power source voltage line, and applying a second power source voltage of the high level to the second power source voltage line, in a first period; and applying the first control signal having the high level to the first control line, applying the first control signal having the high level to the first power source voltage line, and applying the second power source voltage having the low level to the second power source voltage line, in a second period after the first period.

In some embodiments, the aging period includes a second aging period, wherein the second aging period includes: aging the third transistor by applying a first control signal having the low level to the first control line, applying the first control signal having the low level to the first power source voltage line, and applying a second power source voltage of the high level to the second power source voltage line, in a first period in a first period; and aging the first transistor and the third transistor by applying a first control signal of the high level to the first control line, applying the first control signal having the high level to the first power source voltage line, and applying the second power source voltage having the low level to the second power source voltage line, in a second period after the first period.

In some embodiments, in the second period, a difference value between the high level and the low level of a data voltage is smaller than that between the high level and the low level of the first power source voltage.

In some embodiments, the aging period further includes a third aging period, wherein a third period before the second period includes: applying a scan signal having a turn-on level to a plurality of scan lines connected to the plurality of pixels, and applying a data signal of high level to a plurality of data lines connected to the plurality of pixels.

In some embodiments, in the third period, scan signals having the turn-on level are concurrently applied to the plurality of scan lines.

In some embodiments, the method further includes: applying a first control signal having the low level to the first control line in an on-bias period; applying the first power source voltage of a low level to the first power source voltage line, applying the first control signal having the low level to the first control line, applying a second control signal having a turn-on level to the second control line, and applying a scan signal having a turn-off level to the scan line, in a first initialization period; applying the first power source voltage of the low level to the first power source voltage line, applying the first control signal having the high level to the first control line, applying a second control signal having the turn-on level to the second control line, and applying a scan signal having the turn-on level to the scan line, in a second initialization period; and applying the first power source voltage of the high level to the first power source voltage line, applying the first control signal having the high level to the first control line, applying a second control signal having the turn-on level to the second control line, and applying a scan signal having the turn-on level to the scan line, in a compensation period, wherein the on-bias period, the first initialization period, the second initialization period, the compensation period, and the aging period are sequentially performed.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
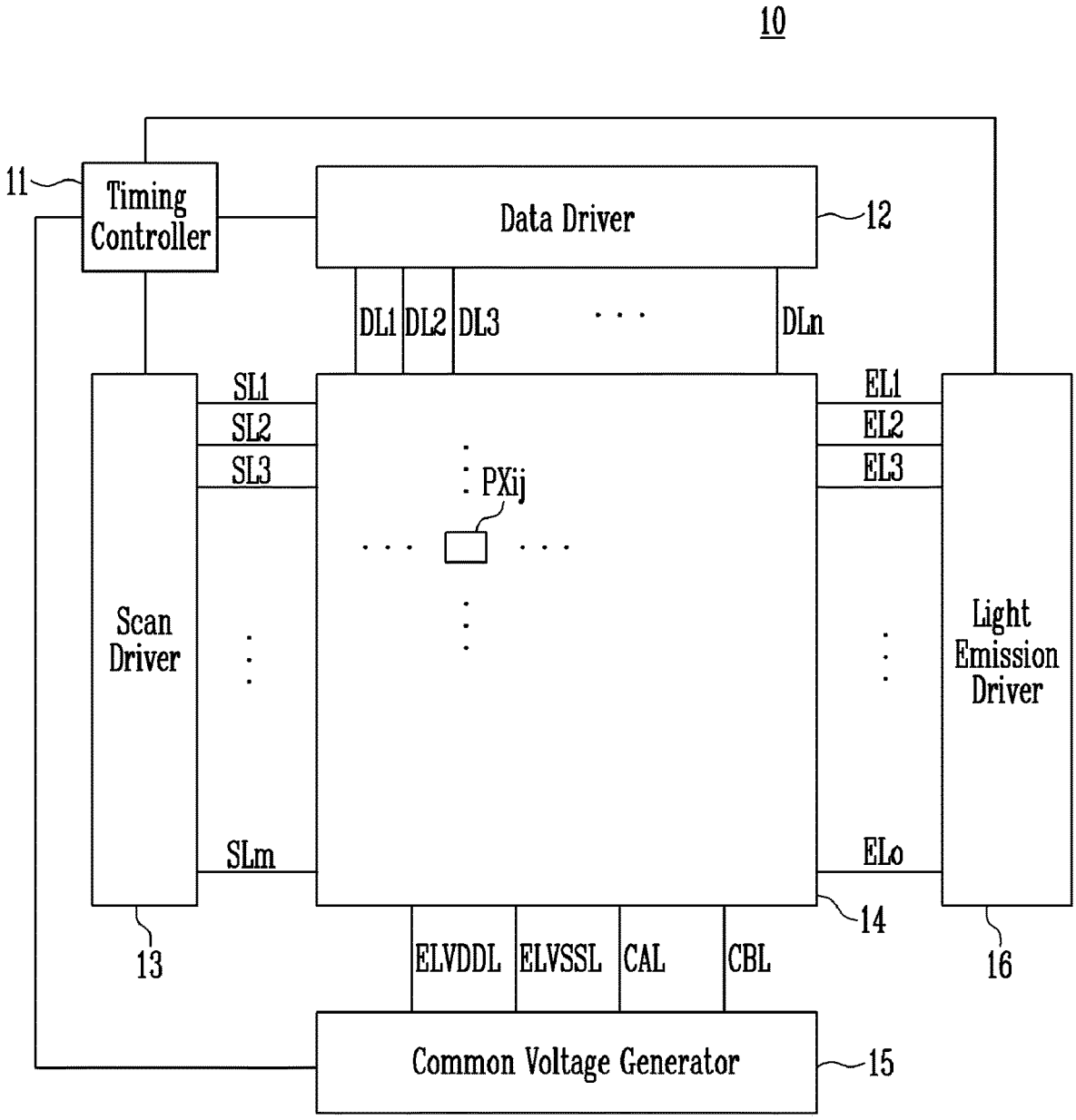
FIG. 1 is a block diagram of a display device according to an example embodiment of the present invention.

The aspects and features of the present invention and the manner for achieving them will become apparent with reference to the embodiments described in detail below with reference to the accompanying drawings. However, the present invention may be embodied in many different ways and should not be construed as being limited to the embodiments set forth herein, these embodiments are rather provided so that this disclosure will be thorough and complete and will fully convey the concept of the present invention to those skilled in the art, and the present invention is only defined by the scope of the appended claims and equivalents thereof.

Like reference numerals refer to like elements throughout the specification. When describing the present invention, if it is determined that a detailed description of related well-known techniques would obscure the subject matter of the present invention, the detailed description of them may be omitted.

It is to be understood that each of the features of the various embodiments of the present invention may be partially or entirely combined or combined with each other, and technically cooperate or work together as will be appreciated by those skilled in the art. The embodiments may be realized independently with respect to each other, and may be realized in conjunction with each other.

The preferred embodiments of the present invention will now be described in detail with reference to accompanying drawings.

FIG. 1 is a block diagram of a display device according to an embodiment of the present invention.

Referring to FIG. 1, a display device 10 according to an embodiment of the present invention may include a timing controller 11, a data driver 12, a scan driver 13, a pixel unit 14, a common voltage generator 15, and a light emission driver 16.

The timing controller 11 may generate a clock signal, a scan start signal, and the like to conform to a specification of the scan driver 13 based on the received control signals and provide the clock signal, the scan start signal, and the like to the scan driver 13. The timing controller 11 may supply the data driver 12 with grayscale values and control signals modified or held to conform to a specification of the data driver 12 based on the received grayscale values and control signals. In addition, the timing controller 11 may provide a clock signal, a light emission stop signal, and the like to the light emission driver 16 in accordance with a specification of the light emission driver 16.

The data driver 12 may generate data voltages to be provided to data lines DL1 to DLn using the grayscale values (or data) and the control signals received from the timing controller 11, where n may be a natural number. For example, the data voltages generated in units of pixel rows may be concurrently (e.g., simultaneously) applied to the data lines DL1 to DLn.

The scan driver 13 may receive control signals such as the clock signal, the scan start signal, and the like from the timing controller 11 to generate scan signals to be provided to scan lines SL1 to SLm, where m may be a natural number. The scan driver 13 may select pixels to which the data voltages are to be written by providing the scan signals through the scan lines SL1 to SLm. For example, the scan driver 13 may sequentially select pixel rows to which the data voltages are to be written by sequentially providing the scan signals at a turn-on level to the scan lines SL1 to SLm. The scan driver 13 may be configured in the form of a shift register and may generate scan signals in a manner that sequentially transfers a scan start signal to a next stage circuit under the control of the clock signal. In addition, stage circuits of the scan driver 13 may concurrently (e.g., simultaneously) provide the scan signals at a turn-on level to corresponding scan lines SL1 to SLm according to a global control signal.

The pixel unit 14 may include pixels. Each of the pixels may be connected to a data line and a scan line corresponding thereto. For example, when data voltages for one pixel row are applied to the data lines DL1 to DLn from the data driver 12, the data voltages may be written to one pixel row connected to the scan lines SL1 to SLm, which are supplied with the scan signals of the turn-on level.

The common voltage generator 15 may generate common voltages commonly applied to the pixels of the pixel unit 14. The common voltages may include a first power source voltage, a second power source voltage, a first control voltage, and a second control voltage. The first power source voltage may be applied to a first power source voltage line ELVDDL, the second power source voltage may be applied to a second power source voltage line ELVSSL, the first control voltage may be applied to a first control line CAL, and the second control voltage may be applied to a second control line CBL.

The common voltage generator 15 may be implemented in various suitable forms. For example, the common voltage generator 15 may be incorporated in part or all of the data driver 12. The first power source voltage and the second power source voltage may be generated in the common voltage generator 15 in the form of a DC-DC converter, and the first control voltage and the second control voltage may be generated in the data driver 12.

In another embodiment, the common voltage generator 15 may be incorporated in part or all of the timing controller 11. For example, the first power source voltage and the second power source voltage may be generated in the common voltage generator 15 in the form of a DC-DC converter, and the first control voltage and the second control voltage may be generated in the timing controller 11.

In another embodiment, the common voltage generator 15 may be incorporated in part or all of the timing controller 11 and the data driver 12. For example, the first power source voltage and the second power source voltage may be generated in the common voltage generator 15 in the form of a DC-DC converter, the first control voltage having a relatively large load may be generated in the data driver 12, and the second control voltage having a relatively small load may be generated in the timing controller 11.

The light emission driver 16 may receive the clock signal, the light emission stop signal, and the like from the timing controller 11 to generate light emission signals to be provided to light emission lines EL1 to ELo, where o may be a natural number. For example, the light emission driver 16 may sequentially provide the light emission signals having pulses of a turn-off level to the light emission lines EL1 to ELo. The light emission driver 16 may be configured in the form of a shift register and may generate the light emission signals in a manner that sequentially transmits the light emission stop signal having a pulse shape of a turn-off level to a next stage circuit under the control of the clock signal.

Figure 2:
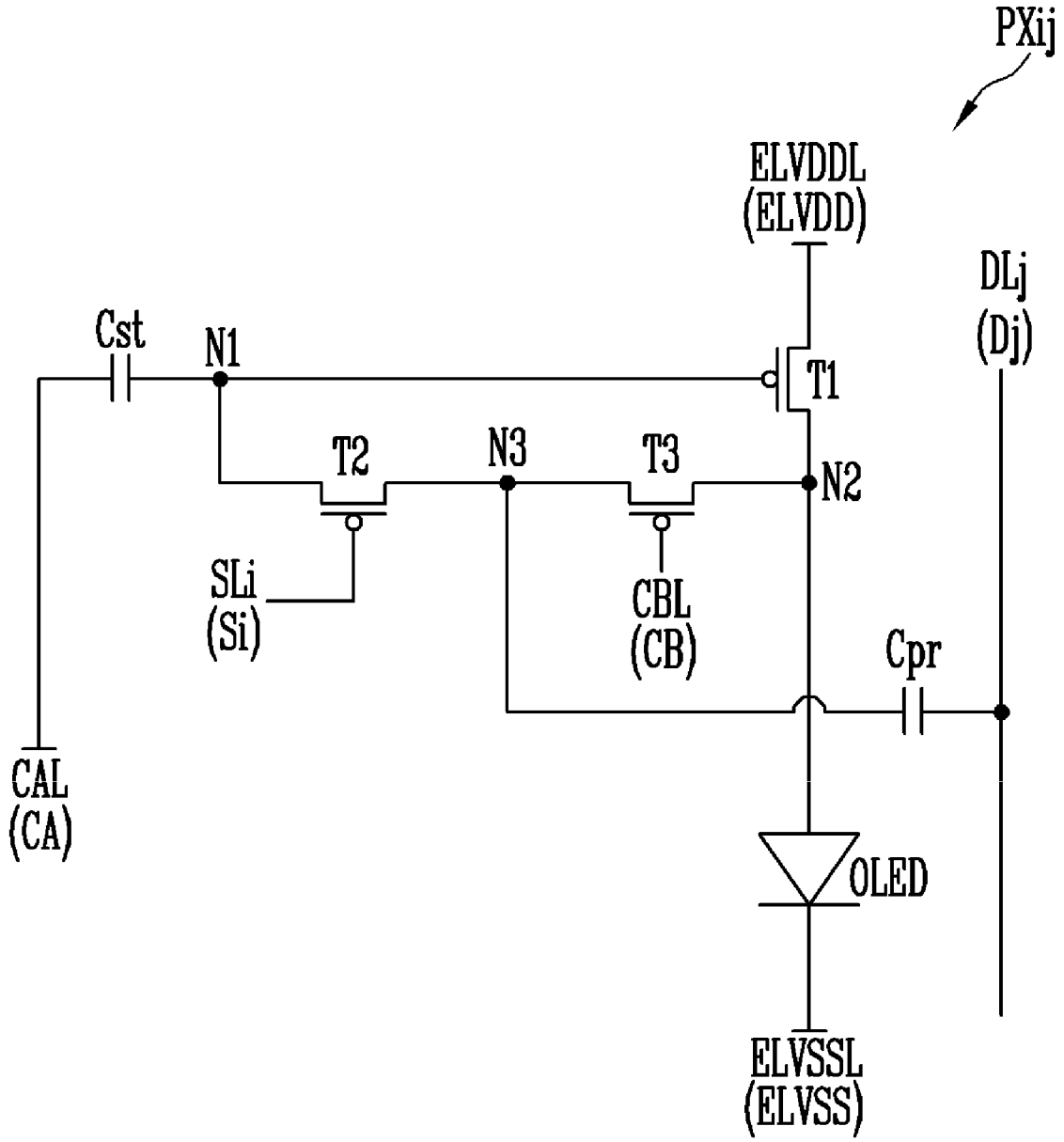
FIG. 2 is a circuit diagram of a pixel according to an example embodiment of the present invention.

FIG. 2 is a circuit diagram of a pixel according to an embodiment of the present invention. It is assumed that a pixel PXij in FIG. 2 is a pixel connected to an i-th scan line SLi and a j-th data line DLj among the pixels in FIG. 1, where i and j may be natural numbers.

Referring to FIG. 2, the pixel PXij according to an embodiment of the present invention may include first, second, and third transistors T1, T2, and T3, first and second capacitors Cst and Cpr, and an organic light emitting diode OLED.

In this embodiment, the first, second, and third transistors T1, T2, and T3 are shown as P-type transistors. Hereinafter, for convenience of explanation, a low level voltage applied to a gate electrode of a transistor is referred to as a turn-on level and a high level voltage applied to the gate electrode of the transistor is referred to as a turn-off level.

Those skilled in the art will be able to implement this embodiment by changing at least one of the first, second, and third transistors T1, T2, and T3 to an N-type transistor. A P-type transistor may be turned on when a gate-source voltage is less than a threshold voltage (e.g., a negative value). An N-type transistor may be turned on when the gate-source voltage exceeds the threshold voltage (e.g., a positive value). Thus, in embodiments in which one or more of the first, second, and third transistors T1, T2, and T3 are implemented as N-type transistors, the turn-on and turn-off levels for the corresponding one or more of the first, second, and third transistors T1, T2, and T3 may be a high level voltage and a low level voltage, respectively, applied to the corresponding gate electrode(s).

The first transistor T1 may include a gate electrode connected to a first node N1, one electrode connected to a first power source voltage line ELVDDL, and the other electrode connected to a second node N2. The first transistor T1 may be referred to as a driving transistor.

The second transistor T2 may include a gate electrode connected to the scan line SLi, one electrode connected to the first node N1, and the other electrode connected to a third node N3. The second transistor T2 may be referred to as a switching transistor, a scan transistor, or the like.

The third transistor T3 may include a gate electrode connected to a second control line CBL, one electrode connected to the third node N3, and the other electrode connected to the second node N2. The third transistor T3 may be referred to as an initialization transistor.

The first capacitor Cst may include one electrode connected to the first node N1 and the other electrode connected to the first control line CAL. The first capacitor Cst may be referred to as a storage capacitor.

The second capacitor Cpr may include one electrode connected to the third node N3 and the other electrode connected to the data line DLj.

The organic light emitting diode OLED may include an anode electrode connected to the second node N2 and a cathode electrode connected to the second power source voltage line ELVSSL.

A first power source voltage ELVDD may be applied to the first power source voltage line ELVDDL and a second power source voltage ELVSS may be applied to the second power source voltage line ELVSSL. A first control voltage CA may be applied to the first control line CAL and a second control voltage CB may be applied to the second control line CBL. A scan signal Si may be applied to the scan line SLi and a data voltage Dj may be applied to the data line DLj.

A driving current path may include the first power source voltage line ELVDDL, one electrode and the other electrode of the first transistor T1, the anode electrode and the cathode electrode of the organic light emitting diode OLED, and the second power source voltage line ELVSSL. A driving current flowing in the driving current path exceeds a certain level, so that a capacitance Col of the organic light emitting diode OLED is charged and the organic light emitting diode OLED may emit light.

Figure 3:
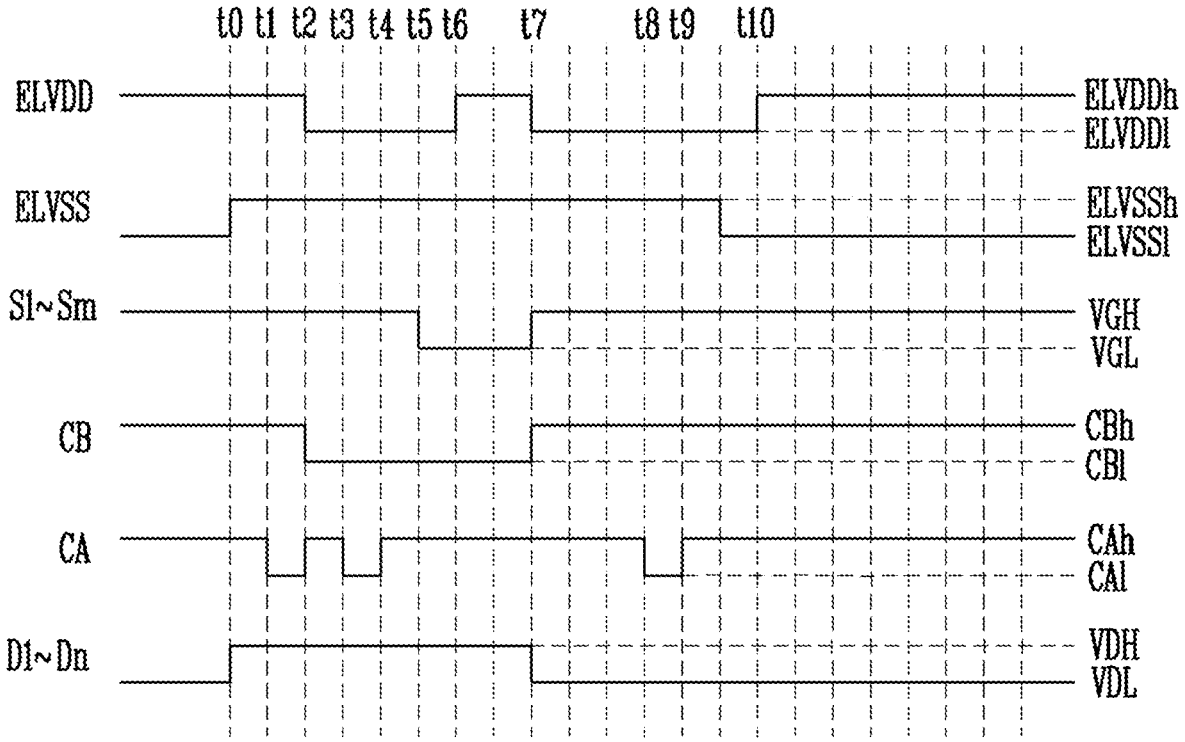
FIG. 3 is a timing diagram of a driving method of a display device according to an example embodiment of the present invention.

FIG. 3 is a timing diagram illustrating a driving method of a display device according to an embodiment of the present invention. FIGS. 4 to 7 are circuit diagrams illustrating a driving method of a display device according to an embodiment of the present invention. The timing diagram of FIG. 3 illustrates a driving process during one aging frame for aging the second transistor T2 and the third transistor T3. At this time, an aging of a transistor may mean a state in which a potential difference between one electrode and the other electrode of the transistor is maintained above a reference potential difference when the transistor is in a turn-off state. The reference potential difference may mean a potential difference at which an off-current of the transistor may be lowered through the aging. For example, the reference potential difference may be a difference value between a high level ELVDDh and a low level ELVDDI of the first power source voltage ELVDD. The transistor is aged so that an off-current level of the transistor may be reduced. The driving process during one aging frame of FIG. 3 may be performed before an image frame in which an image is displayed.

For example, the second power source voltage ELVSS may be raised from a low level ELVSSI to a high level ELVSSh at a zeroth time t0. At this time, the first power source voltage ELVDD may be maintained at the high level ELVDDh. For example, the high level ELVDDh of the first power source voltage ELVDD and the high level ELVSSh of the second power source voltage ELVSS may be equal or substantially equal to each other. The organic light emitting diode OLED may not emit light because a voltage difference between the anode electrode and the cathode electrode of the organic light emitting diode OLED is insufficient. A voltage of a high level VDH may be concurrently (e.g., simultaneously) applied to the data lines DL1 to DLn at the zeroth time t0.

The first control voltage CA may be changed from a high level CAh to a low level CAI at a first time t1. As the first control voltage CA is dropped, a voltage of the first node N1 capacitively coupled to the first control line CAL by the first capacitor Cst may also be dropped. Accordingly, the first transistor T1 may be turned on. The first transistor T1 may be turned on in a period t1 to t2 and the second node N2 may be connected to the first power source voltage line ELVDDL. The period t1 to t2 may be referred to as an on-bias period. The on-bias period may correspond to an on-bias step of the driving method. In the on-bias period, the first transistor T1 may be in a turn-on state.

The first power source voltage ELVDD may be dropped from the high level ELVDDh to the low level ELVDDI at a second time t2. A reverse voltage may be applied to the anode electrode and the cathode electrode of the organic light emitting diode OLED, thereby preventing or substantially preventing the organic light emitting diode OLED from emitting light. In addition, the first control voltage CA may be changed from the low level CAI to the high level CAh and the second control voltage CB may be changed from a turn-off level CBh to a turn-on level CB1, whereby the third transistor T3 may be turned on.

Figure 4:
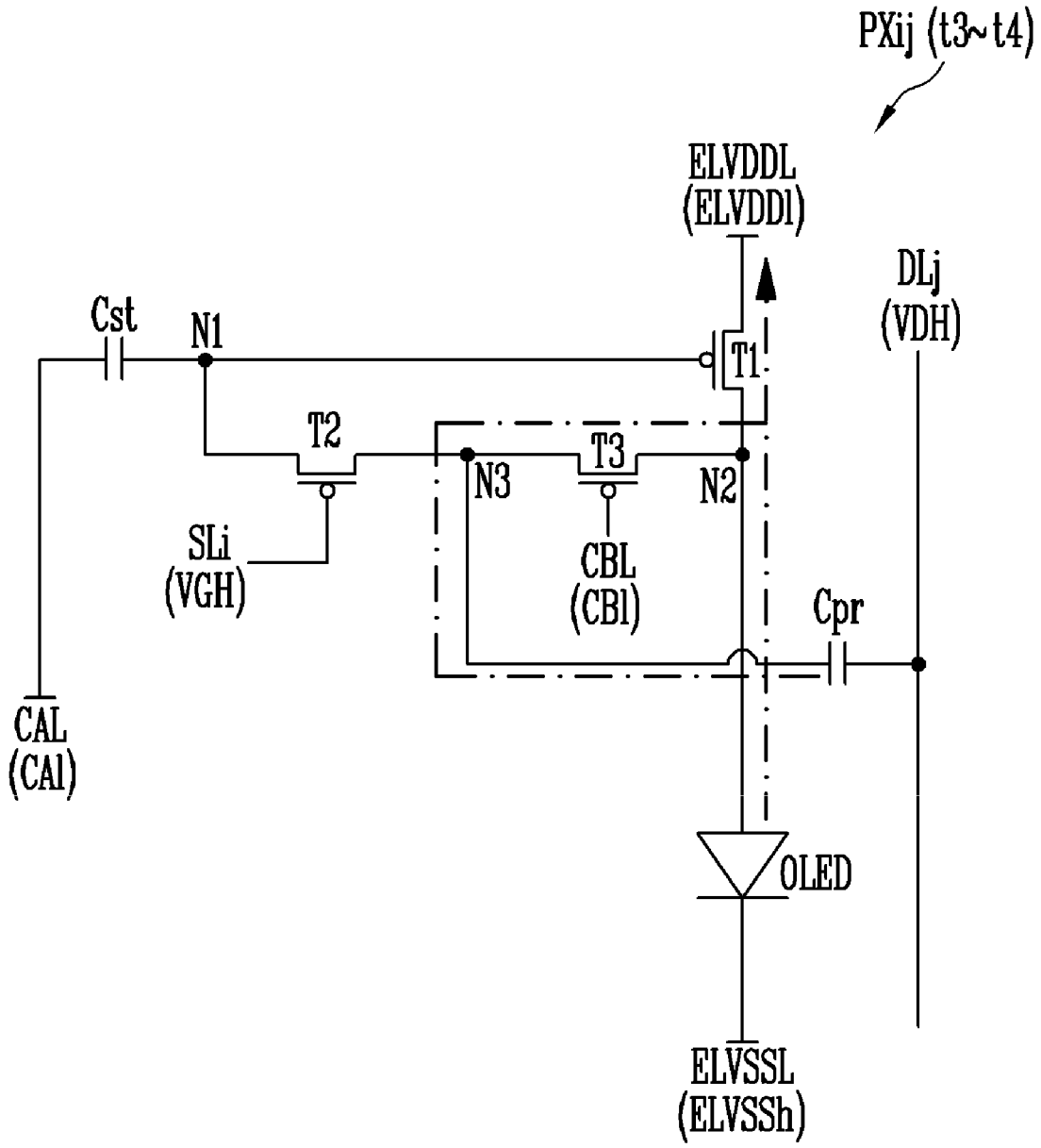
FIGS. 4-7 are circuit diagrams illustrating a driving method of a display device according to an example embodiment of the present invention.

Referring to FIG. 4, the first control voltage CA may be changed from the high level CAh to the low level CAI at a third time t3. As the first control voltage CA is dropped, the voltage of the first node N1 capacitively coupled to the first control line CAL by the first capacitor Cst may also be dropped. Accordingly, the first transistor T1 may be turned on. The first and third transistors T1 and T3 may be turned on in a period t3 to t4 and the second and third nodes N2 and N3 may be connected to the first power source voltage line ELVDDL. The anode electrode of the organic light emitting diode OLED and the second capacitor Cpr may be initialized to the first power source voltage ELVDD of the low level ELVDDI.

The period t3 to t4 may be referred to as a first initialization period. The first initialization period may correspond to a first initialization step of the driving method. In the first initialization step, the second node N2 and the third node N3 may be initialized by the first power source voltage ELVDD of the low level ELVDDI.

The first control voltage CA may be changed from the low level CAI to the high level CAh at a fourth time t4. In this case, although the voltage of the first node N1 may slightly rise, the amount of the voltage raised at the first node N1 may be smaller than a difference between the low level CAI and the high level CAh since the first node N1 is connected to the capacitive elements Col and Cpr via the third node N3 and the second node N2.

Scan signals . . . , S(i−1), Si, S(i+1), . . . of a turn-on level VGL may be concurrently (e.g., simultaneously) applied to the scan lines at a fifth time t5. Since the first, second, and third nodes N1, N2, and N3 are connected to each other, the first, second, and third nodes N1, N2, and N3 may be charge-shared and initialized. Thus, the first capacitor Cst may be additionally initialized. At this time, the first transistor T1 may be diode-connected by the second and third transistors T2 and T3.

A period t5 to t6 may be referred to as a second initialization period. The second initialization period may correspond to a second initialization step of the driving method. In the second initialization step, the first, second, and third nodes N1, N2, and N3 may be initialized while dividing the voltage.

At this time, the scan signals . . . , S(i−1), Si, S(i+1), . . . may be changed to the turn-on level VGL at the fifth time t5 following the fourth time t4 at which point the first control voltage CA is changed from the low level CAI to the high level CAh. When the scan signals . . . , S(i−1), Si, S(i+1), . . . are changed to the turn-on level VGL before the fourth time t4 at which point the first control voltage CA is changed from the low level CAI to the high level CAh, brightness may not be stabilized due to an occurrence of mura defects in the pixels. The scan signals . . . , S(i−1), Si, S(i+1), . . . are changed to the turn-on level VGL at the fifth time t5 after the fourth time t4 at which point the first control voltage CA is changed from the low level CAI to the high level CAh so that a stability of the brightness of the pixels may be improved (e.g., increased).

Figure 5:
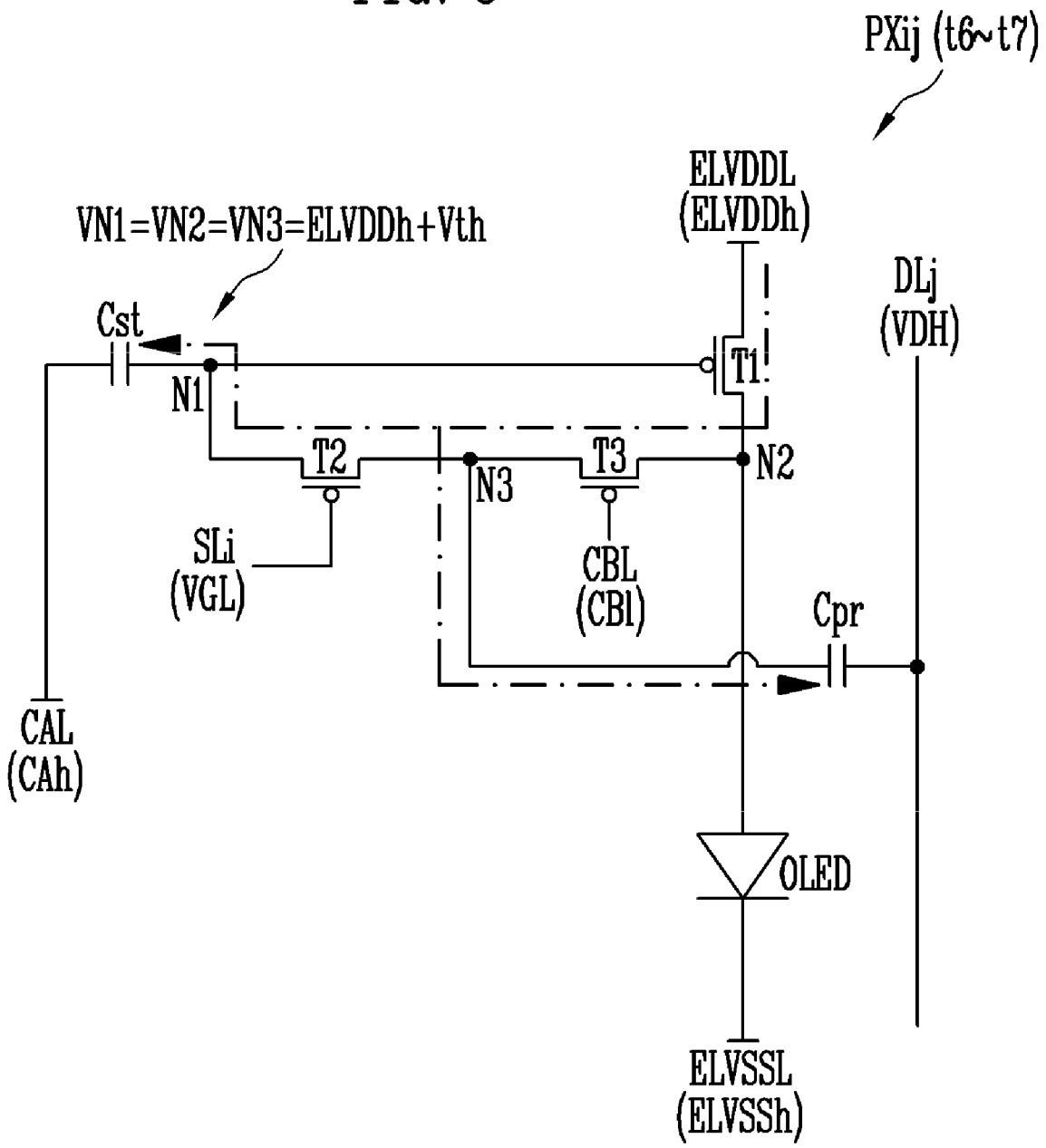

Referring to FIG. 5, the first power source voltage ELVDD may be raised from the low level ELVDDI to the high level ELVDDh at a sixth time t6. Since the first transistor T1 is diode-connected, a voltage obtained by adding a threshold voltage Vth of the first transistor T1 to the first power source voltage ELVDD of the high level ELVDDh may be applied to the first node N1, the second node N2 and the third node N3. First, second, and third node voltages VN1, VN2, and VN3 may have voltage values obtained by adding the threshold voltage Vth of the first transistor T1 to the first power source voltage ELVDD of the high level ELVDDh. At this time, since the threshold voltage Vth is negative, the first, second, and third node voltages VN1, VN2, and VN3 may be lower than the first power source voltage ELVDD of the high level ELVDDh. Accordingly, a voltage corresponding to a difference between the first node voltage VN1 and the first control voltage CA of the high level CAh may be written to the first capacitor Cst during a period t6 to t7.

The period t6 to t7 may be referred to as a compensation period. The compensation period may correspond to a compensation step of the driving method. In the compensation period, the second control voltage CB and the scan signal Si may be at the turn-on levels CB1 and VGL, respectively.

Figure 6:
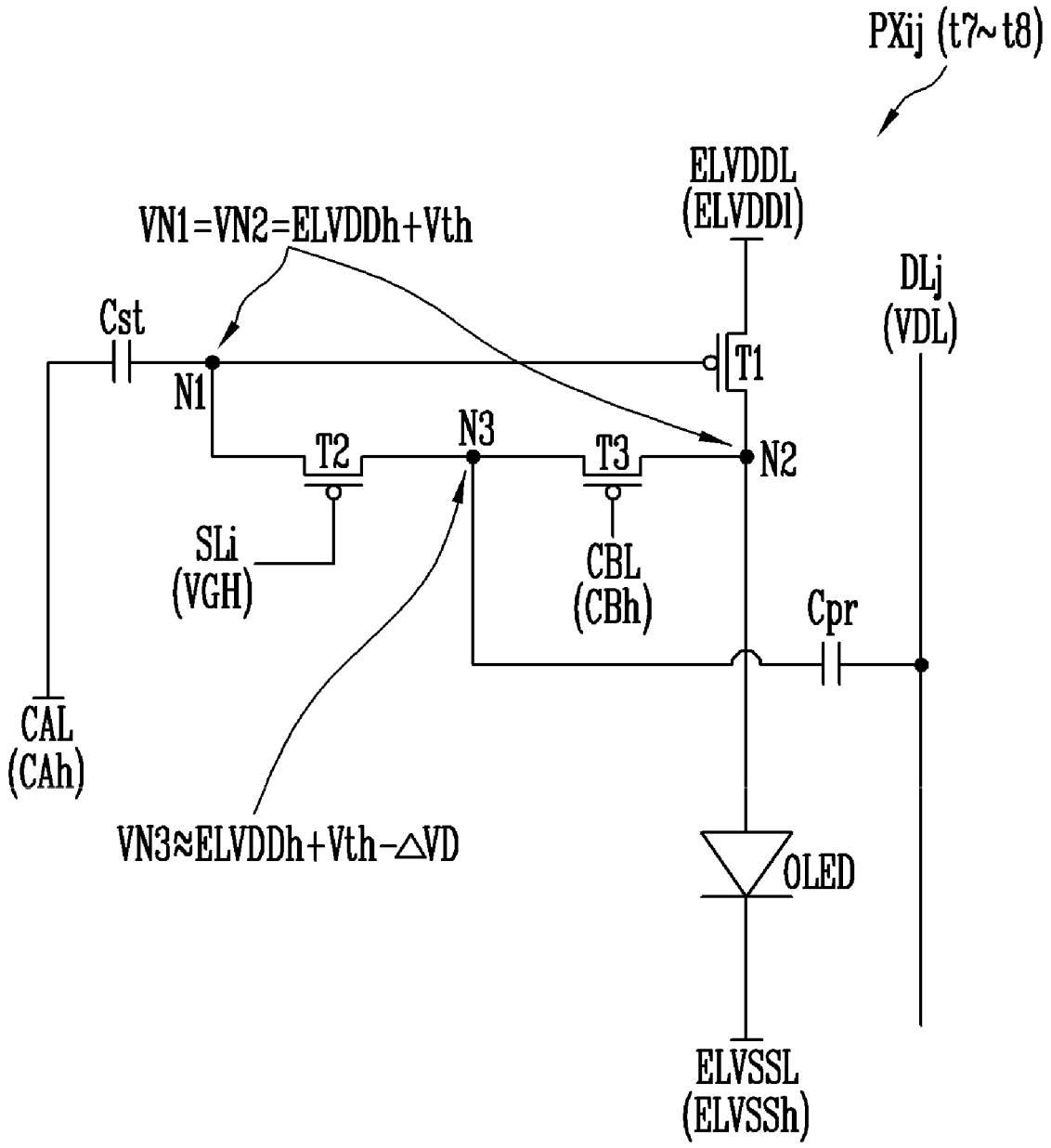

Referring to FIG. 6, at a seventh time t7, the first power source voltage ELVDD may be dropped from the high level ELVDDh to the low level ELVDDI, the second control voltage CB may be changed from the turn-on level CB1 to the turn-off level CBh, and scan signals S1 to Sm may be changed from the turn-on level VGL to a turn-off level VGH. The second and third transistors T2 and T3 are turned off and a diode connection of the first transistor T1 may be released. Data voltages D1 to Dn of a low level VDL may be concurrently (e.g., simultaneously) applied to the data lines DL1 to DLn. The third node N3 may be capacitively coupled to the data lines DL1 to DLn by the second capacitor Cpr. The voltage of the third node N3 may be dropped to a difference voltage between a voltage obtained by adding the threshold voltage Vth of the first transistor T1 to the first power source voltage ELVDD and a voltage obtained by subtracting a value similar to a difference value ΔVD between the high level VDH and the low level VDL of the data voltages D1 to Dn. That is, the third node voltage VN3 may be similar to a voltage obtained by subtracting the difference value ΔVD between the high level VDH and the low level VDL of the data voltages D1 to Dn from the voltage obtained by adding the threshold voltage Vth of the first transistor T1 to the first power source voltage ELVDD.

The difference value ΔVD between the high level VDH and the low level VDL of the data voltages D1 to Dn may be larger than a difference value ΔELVDD between the high level ELVDDh and the low level ELVDDI of the first power source voltage ELVDD. For example, the difference value ΔVD of the data voltages D1 to Dn may be 30 V and the difference value ΔELVDD of the first power source voltage ELVDD may be 8.5 V. The difference value ΔVD of the data voltages D1 to Dn may not be limited to this example and the difference value ΔELVDD of the first power source voltage ELVDD may be set to a specific value larger than 8.5 V.

A difference value between the voltage VN1 of the first node and the voltage VN3 of the third node may be similar to the difference value ΔVD between the high level VDH and the low level VDL of the data voltages D1 to Dn. A potential difference between one electrode and the other electrode of the second transistor T2 turned off may be significantly larger than the difference value ΔELVDD between the high level ELVDDh and the low level ELVDDI of the first power source voltage ELVDD.

Similarly, a difference value between the voltage VN2 of the second node and the voltage VN3 of the third node may be similar to the difference value ΔVD of the data voltages D1 to Dn. A potential difference between one electrode and the other electrode of the third transistor T3 turned off may be significantly larger than the difference value ΔELVDD of the first power source voltage ELVDD.

The first control voltage CA may be changed from the high level CAh to the low level CAl at an eighth time t8. As the first control voltage CA is dropped, the voltage of the first node N1 may also be dropped. Accordingly, the first transistor T1 may be turned on. At a period t8 to t9, the first transistor T1 may be in the turned-on state, the second node N2 may be connected to the first power source voltage line ELVDDL, and the second node voltage VN2 may be initialized to the first power source voltage ELVDD of the low level ELVDDI. At this time, the first power source voltage ELVDD may be at the low level ELVDDI and the second power source voltage ELVSSL may be at the high level ELVSSh. Therefore, the organic light emitting diode OLED may not emit light. The first control voltage CA may be changed from the low level CAl to the high level CAh again at a ninth time t9.

During a period t7 to t10, the scan signals S1 to Sm may be maintained at the turn-off level VGH continuously and the data voltages D1 to Dn may be maintained at the low level VDL continuously. The second transistor T2 may be maintained at a turn-off state and the data voltages D1 to Dn may not be transmitted to the first node N1. Thus, the first node voltage VN1 may be maintained at the voltage obtained by adding the threshold voltage Vth of the first transistor T1 to the first power source voltage ELVDD.

At a tenth time t10, the first power source voltage ELVDD may be raised from the low level ELVDDI to the high level ELVDDh and the second power source voltage ELVSS may be at the low level ELVSSI.

Figure 7:
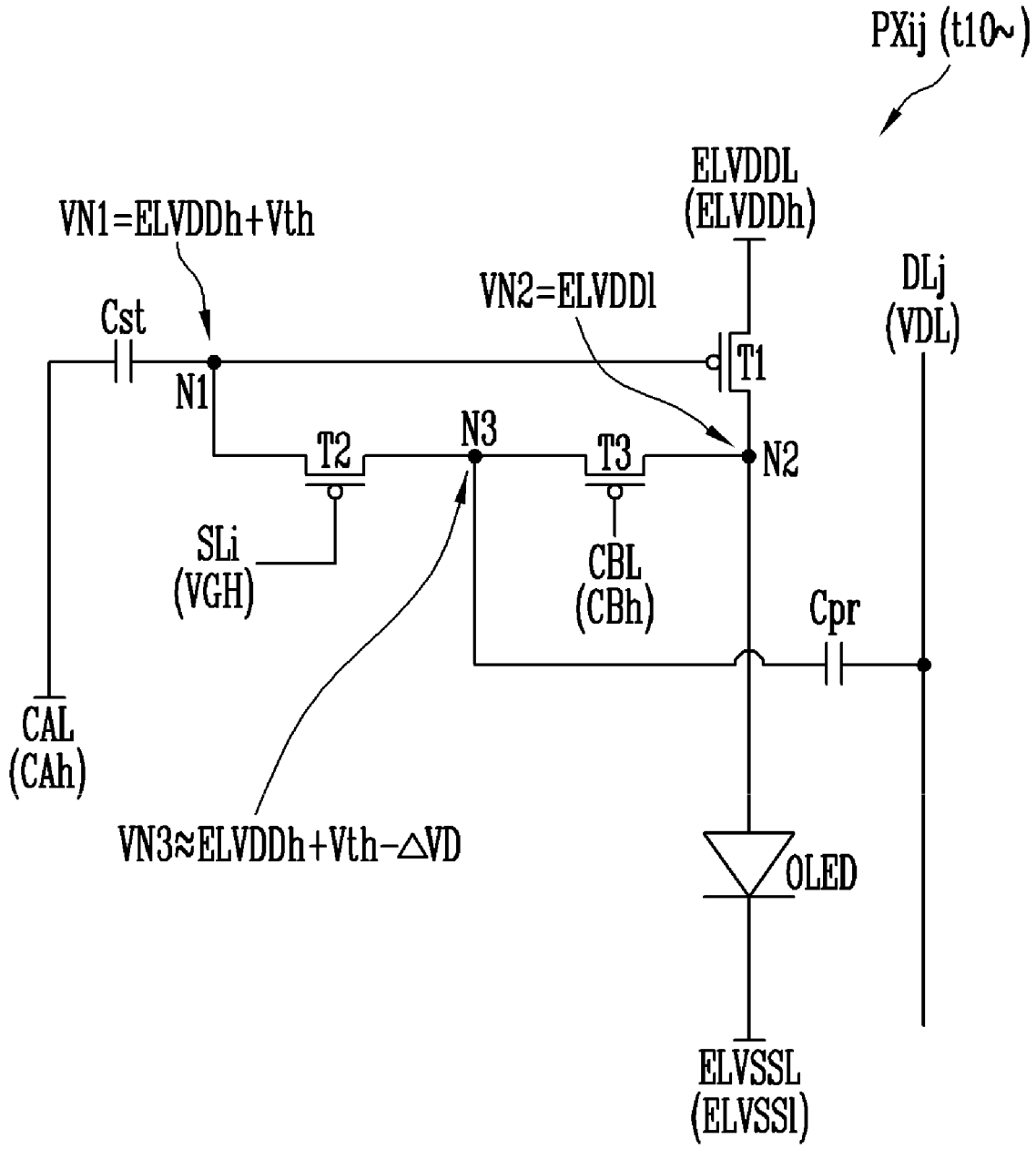

Referring to FIG. 7, a period t10~ may be a non-emission period. The non-emission period may correspond to a non-emission step of the driving method of the display device. For example, the second transistor T2 and the third transistor T3 may be maintained in the turn-off state during the period t10~. In addition, during the period t7 to t10, the second transistor T2 may be maintained in the turn-off state. The organic light emitting diode OLED may not emit light as the data voltages D1 to Dn are not applied to the first node N1.

At this time, the first node voltage VN1 may be the voltage obtained by adding the threshold voltage Vth of the first transistor T1 to the first power source voltage ELVDD of the high level ELVDDh, and the second node voltage VN2 may be the first power source voltage ELVDD of the low level ELVDDI. The third node voltage VN3 may be a voltage obtained by subtracting a value similar to the difference value ΔVD of the data voltages D1 to Dn from the voltage obtained by adding the threshold voltage Vth of the first transistor T1 to the first power source voltage ELVDD.

Therefore, a difference value between the first node voltage VN1 and the third node voltage VN3 may be a value similar to the difference value ΔVD of the data voltages D1 to Dn. A potential difference between one electrode and the other electrode of the second transistor T2 turned off may be a value similar to the difference value ΔVD of the data voltages D1 to Dn.

The difference value between the second node voltage VN2 and the third node voltage VN3 may be a difference between the difference value ΔELVDD of the first power source voltage ELVDD and the difference value ΔVD of the data voltages D1 to Dn. As described above, the difference value ΔVD of the data voltages D1 to Dn may be significantly larger than the difference value ΔELVDD of the first power source voltage ELVDD. Therefore, a potential difference between one electrode and the other electrode of the third transistor T3 when turned off may be a remarkably large value.

The display device and the driving method thereof according to an embodiment of the present invention may age the second and third transistors T2 and T3. For example, the second and third transistors T2 and T3 may be aged in a period t7~ after the seventh time t7. The period t7~ may be a first aging period.

The second transistor T2 may be maintained in the turn-off state during the first aging period in the period t7~. The potential difference between one electrode and the other electrode of the second transistor T2 may be set to be significantly higher in the period t7~. For example, in the period t7~, the potential difference between the one electrode and the other electrode of the second transistor T2 may be a value similar to the difference value ΔVD between the high level VDH and the low level VDL of the data voltages D1 to Dn, and may be significantly larger than the difference value ΔELVDD between the high level ELVDDh and the low level ELVDDI of the first power source voltage ELVDD. Therefore, the second transistor T2 may be maintained in the turn-off state after the seventh time t7. The second transistor T2 may be aged by applying a high potential difference to one electrode and the other electrode, and a turn-off current may be lowered.

The third transistor T3 may be maintained in a turn-off state in the period t7~. A potential difference between one electrode and the other electrode of the third transistor T3 may be set to be significantly higher in the period t7~. For example, in a period t7 to t8, the potential difference between one electrode and the other electrode of the third transistor T3 may be a value similar to the difference value ΔVD of the data voltages D1 to Dn. The potential difference between one electrode and the other electrode of the third transistor T3 may be the difference between the difference value ΔELVDD of the first power source voltage ELVDD and the difference value ΔVD of the data voltages D1 to Dn during a period t10~. As described above, the difference value ΔVD of the data voltages D1 to Dn may be significantly larger than the difference value ΔELVDD of the first power source voltage ELVDD. The potential difference between one electrode and the other electrode of the third transistor T3 when turned off may be a remarkably large value. Therefore, the third transistor T3 may be maintained in the turn-off state after the seventh time t7. The third transistor T3 may be aged by applying a high potential difference to one electrode and the other electrode, and a turn-off current may be lowered.

The second transistor T2 and the third transistor T3 are aged and the turn-off currents of the second transistor T2 and the third transistor T3 are lowered so that a dark spot or a mura defect that may occur (e.g., may be visible to a user) at a low grayscale driving may be improved and characteristics of the second and third transistors T2 and T3 may be improved.

On the other hand, the aging frame of the driving method described with reference to FIGS. 3 to 7 is different from the image frame for displaying an image, and may be a non-emission period in which the pixels do not emit light. Therefore, the pixels may not emit light in the aging frame.

The aging frame of the driving method described with reference to FIGS. 3 to 7 may be repeated one or more times before the image frame. In this case, the second and third transistors T2 and T3 may be repeatedly aged several times and may be more stabilized by lowering the turn-off current. The present invention is not limited thereto.

Figure 8:
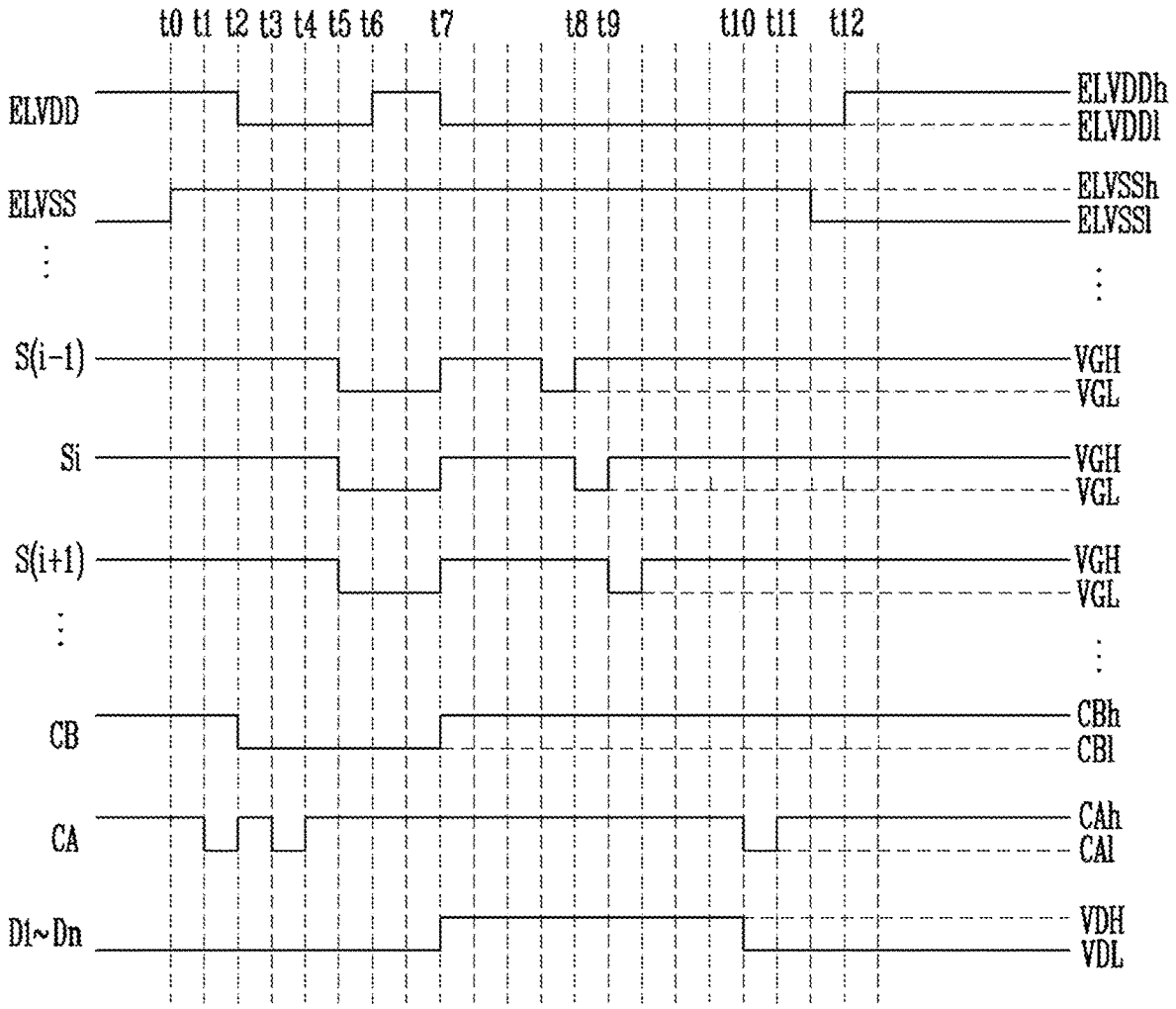
FIG. 8 is a timing diagram illustrating a driving method of a display device according to another example embodiment of the present invention.
Figure 9:
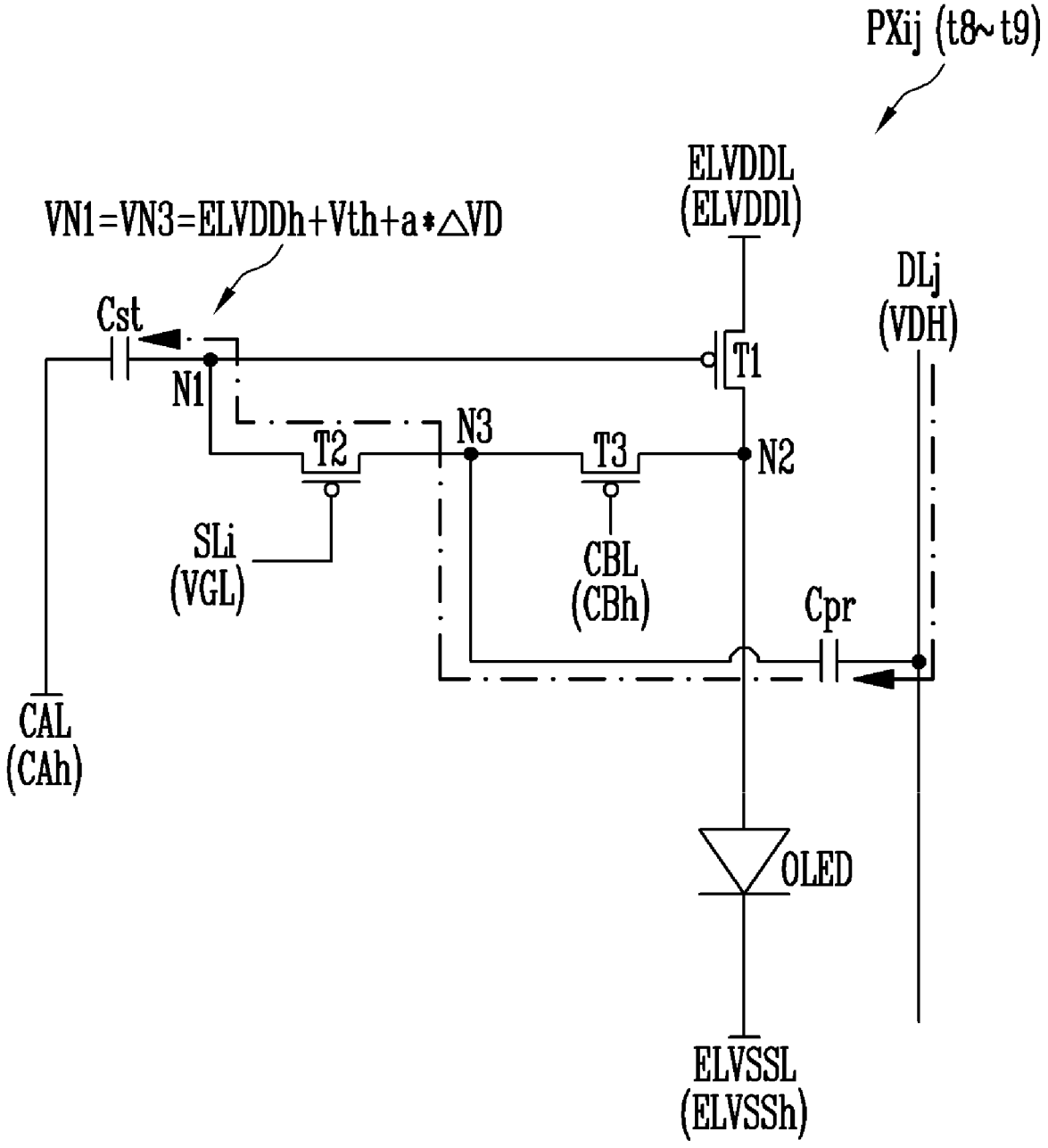
FIGS. 9-10 are circuit diagrams illustrating a driving method of a display device according to another example embodiment of the present invention.
Figure 10:
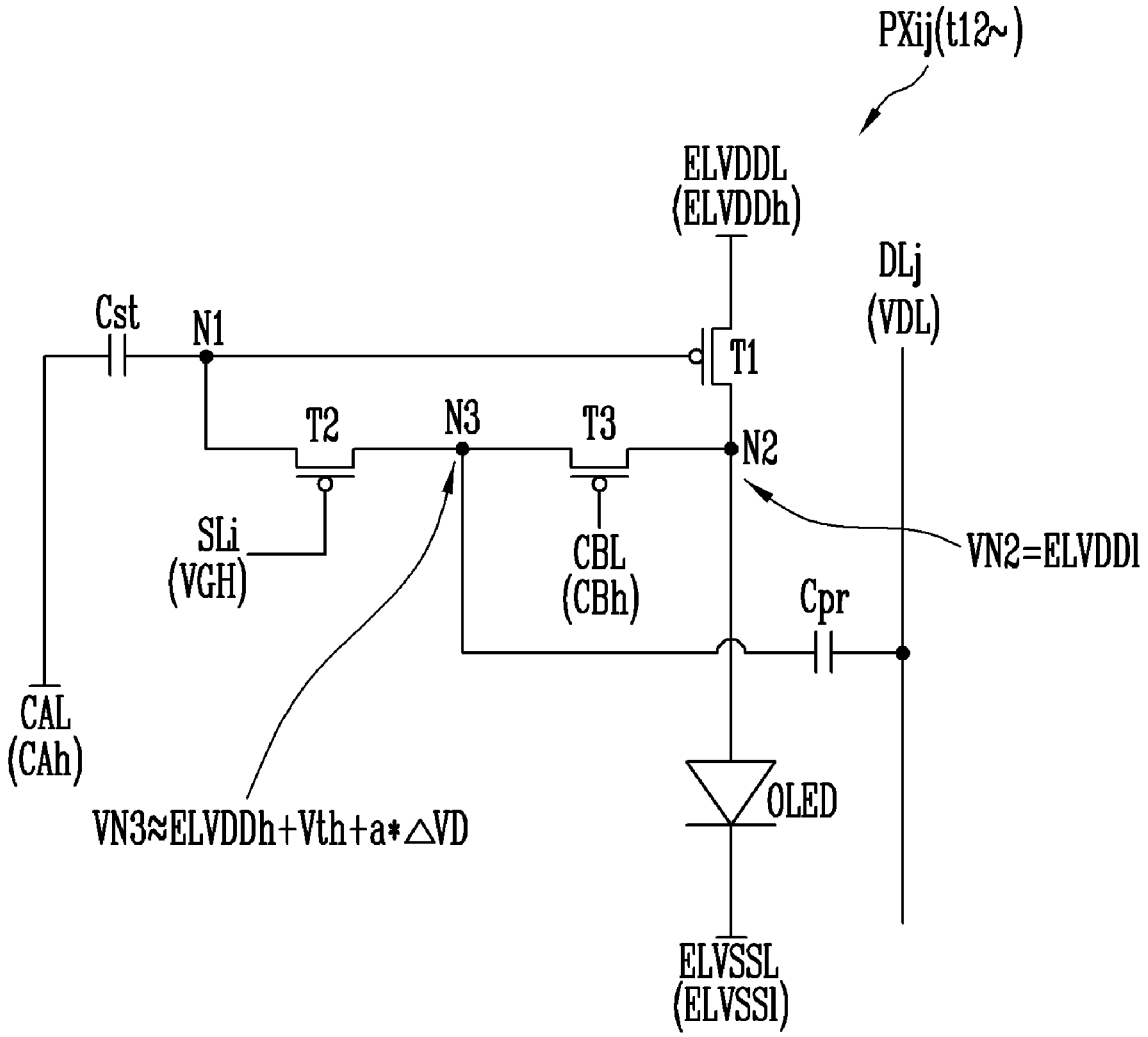

FIG. 8 is a timing diagram illustrating a driving method of a display device according to another embodiment of the present invention. FIGS. 9 and 10 are circuit diagrams illustrating a driving method of a display device according to another embodiment of the present invention. The driving method of FIGS. 8 to 10 is substantially the same as the driving method of FIGS. 1 to 7 except that the scan signals S1 to Sm and the data voltages D1 to Dn are different; as such, redundants descriptions may be omitted.

Referring to FIG. 8, the second power source voltage ELVSS may be raised from the low level ELVSSI to the high level ELVSSh at the zeroth time t0. At this time, the first power source voltage ELVDD may be maintained at the high level ELVDDh. For example, the high level ELVDDh of the first power source voltage ELVDD and the high level ELVSSh of the second power source voltage ELVSS may be equal or substantially equal to each other. The organic light emitting diode OLED may not emit light because a voltage difference between the anode electrode and the cathode electrode of the organic light emitting diode OLED is insufficient. The voltages of the data lines DL1 to DLn at the zeroth time t0 may be maintained at the low level VDL.

The first control voltage CA may be changed from the high level CAh to the low level CAI at the first time t1. As the first control voltage CA is dropped, the voltage of the first node N1 capacitively coupled to the first control line CAL by the first capacitor Cst may also be dropped. Accordingly, the first transistor T1 is turned on. The first transistor T1 is turned on in the period t1 to t2 and the second node N2 may be connected to the first power source voltage line ELVDDL.

The first power source voltage ELVDD may be dropped from the high level ELVDDh to the low level ELVDDI at the second time t2. Accordingly, a reverse voltage is applied to the anode electrode and the cathode electrode of the organic light emitting diode OLED, thereby preventing or substantially preventing unexpected light emitting from the organic light emitting diode OLED. In addition, the first control voltage CA may be changed from the low level CAI to the high level CAh. The second control voltage CB may be changed from the turn-off level CBh to the turn-on level CB1, whereby the third transistor T3 may be turned on.

The first control voltage CA may be changed from the high level CAh to the low level CAI at the third time t3. As the first control voltage CA is dropped, the voltage of the first node N1 capacitively coupled to the first control line CAL by the first capacitor Cst may also be dropped. Accordingly, the first transistor T1 is turned on. The first and third transistors T1 and T3 are turned on in the period t3 to t4 and the second and third nodes N2 and N3 may be connected to the first power source voltage line ELVDDL. The anode electrode of the organic light emitting diode OLED and the second capacitor Cpr may be initialized to the first power source voltage ELVDD of the low level ELVDDI.

The period t3 to t4 may be referred to as a first initialization period. The first initialization period may correspond to a first initialization step of the driving method. In the first initialization step, the second node N2 and the third node N3 may be initialized by the first power source voltage ELVDD of the low level ELVDDI.

The first control voltage CA may be changed from the low level CAI to the high level CAh at the fourth time t4. In this case, although the voltage of the first node N1 may slightly rise, the amount of the voltage raised at the first node N1 may be smaller than a difference between the low level CAI and the high level CAh since the first node N1 is connected to the capacitive elements (Col and Cpr) via the third node N3 and the second node N2.

The scan signals S1 to Sm of the turn-on level VGL may be concurrently (e.g., simultaneously) applied to the scan lines at the fifth time t5. Since the first, second, and third nodes N1, N2, and N3 are connected to each other, the first, second, and third nodes N1, N2, and N3 may be charge-shared and initialized. Thus, the first capacitor Cst may be additionally initialized. At this time, the first transistor T1 may be diode-connected by the second and third transistors T2 and T3.

The period t5 to t6 may be referred to as a second initialization period. The second initialization period may correspond to a second initialization step of the driving method. In the second initialization step, the first, second, and third nodes N1, N2, and N3 may be initialized while dividing the voltage.

At this time, the scan signals S1 to Sm may be changed to the turn-on level VGL at the fifth time t5 following the fourth time t4 at which point the first control voltage CA is changed from the low level CAI to the high level CAh. When the scan signals S1 to Sm are changed to the turn-on level VGL before the fourth time t4 at which point the first control voltage CA is changed from the low level CAI to the high level CAh, brightness may not be stabilized due to an occurrence of a mura defect in the pixels. The scan signals S1 to Sm are changed to the turn-on level VGL at the fifth time t5 after the fourth time t4 at which point the first control voltage CA is changed from the low level CAI to the high level CAh so that a stability of the brightness of the pixels may be improved (e.g., increased).

The first power source voltage ELVDD may be raised from the low level ELVDDI to the high level ELVDDh at the sixth time t6. Since the first transistor T1 is diode-connected, a voltage obtained by adding the threshold voltage Vth of the first transistor T1 to the first power source voltage ELVDD of the high level ELVDDh may be applied to the first node N1, the second node N2 and the third node N3. The first, second, and third node voltages VN1, VN2, and VN3 may have voltage values obtained by adding the threshold voltage Vth of the first transistor T1 to the first power source voltage ELVDD of the high level ELVDDh. At this time, since the threshold voltage Vth is negative, the first, second, and third node voltages VN1, VN2, and VN3 may be lower than the first power source voltage ELVDD of the high level ELVDDh. Accordingly, a voltage corresponding to a difference between the first node voltage VN1 and the first control voltage CA of the high level CAh may be written to the first capacitor Cst during the period t6 to t7.

The period t6 to t7 may be referred to as a compensation period. The compensation period may correspond to a compensation step of the driving method. In the compensation period, the second control voltage CB and the scan signal Si may be at the turn-on levels CB1 and VGL, respectively.

The scan signals . . . , S(i−1), Si, S(i+1), . . . of the turn-on level VGL may be sequentially applied to the scan lines SL1 to SLm during the period t7 to t10. The data voltages D1 to Dn of the high level VDH may be concurrently (e.g., simultaneously) applied to the data lines DL1 to DLn. The data voltages D1 to Dn applied to the data lines DL1 to DLn may not be data voltages . . . , D(i−1)j, Dij, D(i+1)j, . . . synchronized with the scan signals . . . , S(i−1), Si, S(i+1), . . . . Therefore, data may not be written during the period t7 to t10.

For example, the scan signal Si of the turn-on level VGL may be applied to the scan line SLi during the period t8 to t9 and the data voltage Dj of the high level VDH may be applied to the data line DLj. In the period t8 to t9, the second control voltage CB may be at the turn-off level CBh, the scan signal Si may be at the turn-on level VGL, and the voltage level ELVDDI of the first power source voltage ELVDD may be less than or equal to the voltage level ELVSSh of the second power source voltage ELVSS.

Referring to FIG. 9, the first node N1 may be connected to the third node N3 via the turned-on second transistor T2 and the third node N3 may be capacitively coupled to the data line DLj via the second capacitor Cpr. With reference to a path of the first control line CAL, the first capacitor Cst, the second transistor T2, the second capacitor Cpr and the data line DLj, the data voltage Dj of the data line DLj may be changed from the low level VDL to the high level VDH in the period t8 to t9 when compared with the period t6 to t7.

When compared with the period t6 to t7, the first and third node voltages VN1 and VN3 may further reflect the difference value ΔVD between the high level VDH and the low level VDL of the data voltage Dj based on capacitance ratios of the first capacitor Cst and the second capacitor Cpr. Refer to Equations 1 to 3 below.

$$\Delta VD = VDH - VDL \quad \text{Equation 1}$$

$$a = CprF/(CstF + CprF) \quad \text{Equation 2}$$

$$VN1 = VN3 = ELVDDh + Vth + a * \Delta VD \quad \text{Equation 3}$$

Here, CstF is a capacitance of the first capacitor Cst, and CprF is a capacitance of the second capacitor Cpr.

Therefore, the first and third node voltages VN1 and VN3 of a pixel circuit of each of the pixels during the period t7 to t10 may be changed to a voltage in Equation 3. The first node voltage VN1 may be applied to the gate electrode of the first transistor T1 and the turn-off state of the first transistor T1 may be maintained more reliably. The organic light emitting diode OLED may not emit light during a period after a twelfth time t12 to be described below.

Unlike the data voltages D1 to Dn in FIGS. 3 to 7, the difference value ΔVD between the high level VDH and the low level VDL of the data voltages D1 to Dn in FIGS. 8 to 10 may be significantly smaller than the difference value ΔELVDD between the high level ELVDDh and the low level ELVDDI of the first power source voltage ELVDD. For example, the difference value ΔVD of the data voltages D1 to Dn may be 1 V and the difference value ΔELVDD of the first power source voltage ELVDD may be 11.5 V.

At the tenth time t10, the first control voltage CA may be changed from the high level CAh to the low level CAI. As the first control voltage CA is dropped, the voltage of the first node N1 may also be dropped. Thus, the first transistor T1 may be turned on. In a period t10 to t11, the first transistor T1 may be in a turn-on state, the second node N2 may be connected to the first power source voltage line ELVDDL, and the second node voltage VN2 may be equal to or lower than the first power source voltage ELVDD of the low level ELVDDI. At this time, the first power source voltage ELVDD may be at the low level ELVDDI and the second power source voltage ELVSSL may be at the high level ELVSSh. Therefore, the organic light emitting diode OLED may not emit light. At an eleventh time t11, the first control voltage CA may be changed from the low level CAI to the high level CAh again.

Referring to FIG. 10, at the twelfth time t12, the first power source voltage ELVDD may be raised from the low level ELVDDI to the high level ELVDDh and the second power source voltage ELVSS may be at the low level ELVSSI. A period t10~ may be a non-emission period. The first, second, and third transistors T1, T2, and T3 may be maintained in the turn-off state during a period t12~. In addition, the organic light emitting diode OLED may not emit light.

The display device and the driving method thereof according to another embodiment of the present invention may include a second aging period for aging the first and third transistors T1 and T3. The second aging period may be the period t10~ and the second aging period may include a first period t10 to t12 and a second period t12~. The first period t10 to t12 and the second period t12~ may correspond to first and second steps of the driving method of the display device, respectively. For example, the first transistor T1 may be aged in the second period t12~ after the twelfth time t12, and the third transistor T3 may be aged in the first period t10 to t12 and the second period t12~ after the tenth time t10.

For example, the third node N3 may be capacitively coupled by the data lines DL1 to DLn and the second capacitor Cpr in the first period t10 to t12 and the second period t12~. When the data voltages D1 to Dn applied to the data lines DL1 to DLn are lowered by the difference value ΔVD, the third node voltage VN3 may be lowered by a value smaller than the difference value ΔVD. However, as described above, the difference value ΔVD of the data voltages D1 to Dn may be significantly smaller than the difference value ΔELVDD between the high level ELVDDh and the low level ELVDDI of the first power source voltage ELVDD. For example, the difference value ΔVD of the data voltages D1 to Dn may be 1V. Therefore, the second node voltage VN2 may be maintained similar to the voltage value VN3 in Equation 3. The second node voltage VN2 may be lowered to the first power source voltage ELVDD of the low level ELVDDI in the first period t10 to t12 and the second period t12~.

A difference between the second node voltage VN2 and the third node voltage VN3 may be set to correspond to the difference value ΔELVDD between the high level ELVDDh and the low level ELVDDI of the first power source voltage ELVDD. The third transistor T3 may be maintained in the turn-off state in the first period t10 to t12 and the second period t12- and a potential difference between one electrode and the other electrode of the third transistor T3 may correspond to the difference value ΔELVDD between the high level ELVDDh and the low level ELVDDI of the first power source voltage ELVDD. Therefore, the third transistor T3 may be turned on after the tenth time t10 and may be aged by applying a high potential difference to one electrode and the other electrode, and a turn-off current may be lowered.

The first transistor T1 may be maintained in the turn-off state in the second period t12~. One electrode of the first transistor TI may be connected to the first power source voltage line ELVDD so that the first power source voltage ELVDD of the high level ELVDDh may be applied to the first transistor T1. The second node voltage VN2 set to the first power source voltage ELVDD of the low level ELVDDI during the first period t10 to t11 may be maintained in the second period t12~. A potential difference between one electrode and the other electrode of the first transistor T1 may be the difference value ΔELVDD between the high level ELVDDh and the low level ELVDDI of the first power source voltage ELVDD. Therefore, the first transistor T1 may be turned off from the second period t12~ after the twelfth time t12 and may be aged by applying a high potential difference to one electrode and the other electrode, and a turn-off current may be lowered.

Since the first and third transistors T1 and T3 are aged and the turn-off current is lowered, a dark spot or a mura defect that may occur at a low grayscale may be improved and characteristics of the first and third transistors T1 and T3 may be improved.

The aging frame of the driving method described with reference to FIGS. 8 to 10 may be different from an image frame for displaying an image, and may be a non-emission period in which the pixels do not emit light. Therefore, the plurality of pixels may not emit light in the aging frame.

The aging frame of the driving method described with reference to FIGS. 8 to 10 may be repeated one or more times before the image frame. In this case, the first and third transistors T1 and T3 may be repeatedly aged several times and may be more stabilized by lowering the turn-off current. However, the embodiment of the present invention is not limited thereto.

Figure 11:
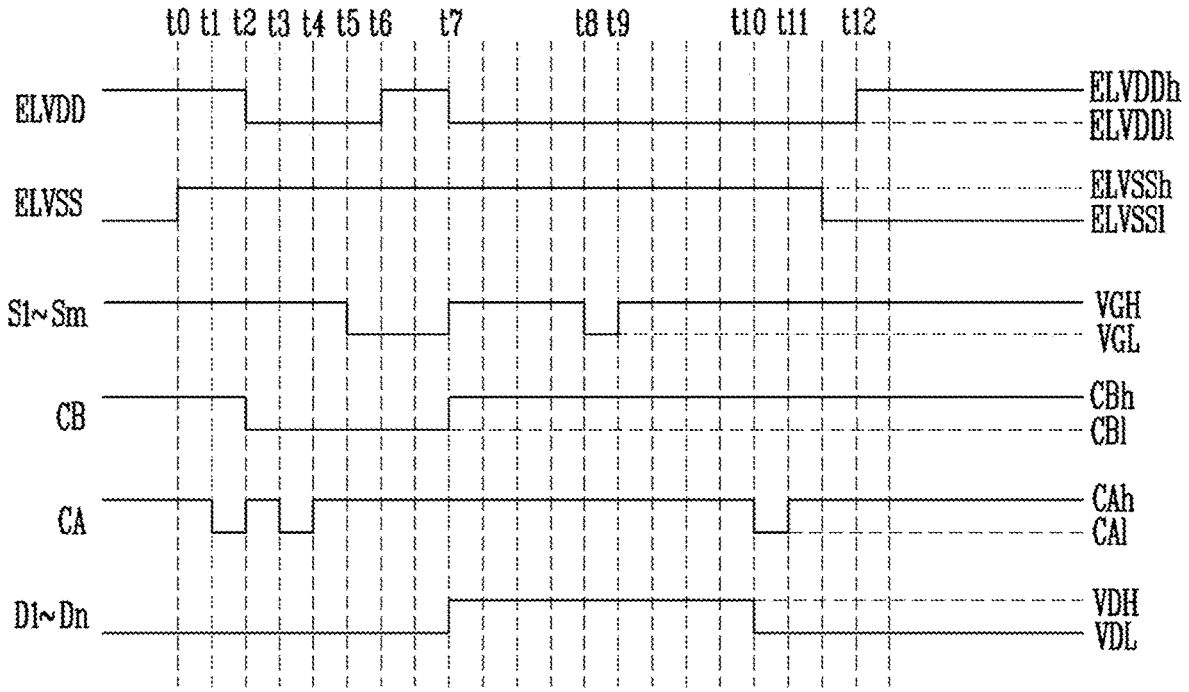
FIG. 11 is a timing diagram illustrating a driving method of a display device according to another example embodiment of the present invention.

FIG. 11 is a timing diagram illustrating a driving method of a display device according to another embodiment of the present invention. The driving method of the display device of FIG. 11 is substantially the same as the driving method of FIGS. 8 to 10 except that the scan signals S1 to Sm are different; as such, and redundant descriptions may be omitted.

Referring to FIG. 11, the scan signals S1 to Sm of the turn-on level VGL may be concurrently (e.g., simultaneously) applied to all of the scan lines SL1 to SLm during the period t7 to t10. For example, the scan signals S1 to Sm of the turn-on level VGL may be concurrently (e.g., simultaneously) applied to all of the scan lines SL1 to SLm during the period t8 to t9.

In the display device and the driving method thereof according to another embodiment of the present invention, the scan signals S1 to Sm of the turn-on level VGL may be concurrently (e.g., simultaneously) applied to all of the scan lines SL1 to SLm so that a time required for applying the scan signals S1 to Sm of the turn-on level VGL to all of the scan lines SL1 to SLm may be shortened. Therefore, the period t7 to t10 may be shortened. Therefore, the period for aging the first and third transistors T1 and T3 may be reduced by shortening one frame period shown in FIG. 11.

The display device and the driving method thereof according to the embodiments of the present invention may reduce an off-current of a transistor by aging at least one of a switching transistor, an initializing transistor, and a driving transistor of a pixel circuit before an image is displayed, so that a dark spot or a mura defect of the display device may be prevented or incidence thereof may be substantially reduced.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer or element is referred to as being "between" two layers or elements, it can be the only layer or element between the two layers or elements, or one or more intervening layers or elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing description is intended to illustrate and describe the present invention. In addition, the foregoing is merely illustrative and explanatory of preferred embodiments of the present invention, and as described above, the present invention may be used in various other combinations, modifications, and environments. Changes or modifications may be made within the scope of the inventive concepts disclosed herein, within the scope of equivalents to those described and/or within the skill or knowledge of those skilled in the art. Accordingly, the foregoing description of the invention is not intended to limit the invention to the embodiments disclosed. In addition, the appended claims should be construed to include other embodiments.

What is claimed is:

1. A display device comprising:

a plurality of pixels, each of the pixels comprising:

an organic light emitting diode; and a plurality of transistors configured to control a current applied to the organic light emitting diode, wherein an aging frame comprises an aging period in which at least one of the plurality of transistors is aged, wherein at least one of the plurality of transistors is in a turn-off state in the aging period, and wherein a potential difference between one electrode and an other electrode of a transistor of the plurality of transistors is equal to or greater than a reference potential difference, the reference potential difference being a difference value between a high level and a low level of a first power source voltage.

2. The display device of claim 1, wherein the plurality of transistors comprise:

a first transistor comprising a gate electrode connected to a first node, an electrode connected to a first power source voltage line, and an other electrode connected to a second node;

a second transistor comprising a gate electrode connected to a scan line, an electrode connected to the first node, and an other electrode connected to a third node; and a third transistor comprising a gate electrode connected to a second control line, one electrode connected to the third node, and the other electrode connected to the second node, wherein each of the pixels comprises:

a first capacitor having one electrode connected to the first node and an other electrode connected to a first control line; and a second capacitor having one electrode connected to the third node and an other electrode connected to a data line, and wherein the organic light emitting diode comprises:

an anode electrode connected to the second node; and a cathode electrode connected to a second power source voltage line.

3. The display device of claim 2, wherein the aging period comprises a first aging period for aging the second transistor and the third transistor, and wherein in the first aging period, a scan signal applied to the scan line is maintained at a turn-off level to turn off the second transistor, a second control signal applied to the second control line is maintained at the turn-off level to turn off the third transistor, and a data voltage applied to the data line is changed from the high level to the low level at a time of the first aging period.

4. The display device of claim 3, wherein a difference value between the high level and the low level of the data voltage is greater than that between the high level and the low level of the first power source voltage.

5. The display device of claim 3, wherein the first aging period comprises:

a first period in which a first control signal applied to the first control line is at the low level, the first power source voltage applied to the first power source voltage line is at the low level, and a second power source voltage applied to the second power source voltage line is at the high level; and a second period in which the first control signal is at the high level, the first power source voltage is at the high level, and the second power source voltage is at the low level.

6. The display device of claim 2, wherein the aging period comprises a second aging period for aging the first transistor and the third transistor, and wherein the second aging period comprises:

a first period in which a first control signal applied to the first control line is at the low level, the first power source voltage applied to the first power source voltage line is at the low level, and a second power source voltage applied to the second power source voltage line is at the high level; and a second period in which the first control signal is at the high level, the first power source voltage is at the high level, and the second power source voltage is at the low level.

7. The display device of claim 6, wherein the third transistor is aged in the first period and the second period, and the first transistor is aged in the second period.

8. The display device of claim 6, wherein a difference value between the high level and the low level of a data voltage in the second aging period is smaller than that between the high level and the low level of the first power source voltage.

9. The display device of claim 6, wherein the aging frame further comprises a third period before the second aging period, and wherein in the third period, a scan signal having a turn-on level is sequentially applied to a plurality of scan lines connected to the plurality of pixels, and a data voltage applied to a plurality of data lines connected to the plurality of pixels is at the high level.

10. The display device of claim 9, wherein in the third period, scan signals having a turn-on level are concurrently applied to the plurality of scan lines.

11. The display device of claim 2, wherein in an on-bias period, a first control signal applied to the first control line is at the low level, and the first transistor is in a turn-on state.

12. The display device of claim 2, wherein in a first initialization period, the first power source voltage applied to the first power source voltage line is at the low level, a first control signal applied to the first control line is at the low level, a second control signal applied to the second control line is at a turn-on level, and a scan signal applied to the scan line is at a turn-off level, and wherein in a second initialization period, the first power source voltage is at the low level, the first control signal is at the high level, the second control signal is at the turn-on level, and the scan signal is at the turn-on level.

13. The display device of claim 2, wherein in a compensation period, the first power source voltage applied to the first power source voltage line is at the high level, a first control signal applied to the first control line is at the high level, a second control signal applied to the second control line is at a turn-on level, and a scan signal applied to the scan line is at the turn-on level.

14. The display device of claim 2, wherein the aging frame is different from an image frame and the plurality of pixels do not emit light during the aging frame.

15. The display device of claim 2, wherein the aging frame is repeated one or more times before an image frame.

16. A driving method of a display device comprising a plurality of pixels, each of the pixels comprising an organic light emitting diode and a plurality of transistors for controlling a current applied to the organic light emitting diode, the method comprising:

aging at least one of the plurality of transistors in an aging period, wherein in the aging period, at least one of the plurality of transistors is in a turn-off state, a potential difference between one electrode and an other electrode of at least one of the plurality of transistors is equal to or greater than a reference potential difference, and the reference potential difference is a difference value between a high level and a low level of a first power source voltage.

17. The method of claim 16, wherein the transistors comprise:

a first transistor having a gate electrode connected to a first node, one electrode connected to a first power source voltage line, and an other electrode connected to a second node;

a second transistor having a gate electrode connected to a scan line, one electrode connected to the first node, and an other electrode connected to a third node; and a third transistor having a gate electrode connected to a second control line, one electrode connected to the third node, and an other electrode connected to the second node, wherein each of the pixels comprises:

a first capacitor having one electrode connected to the first node and an other electrode connected to a first control line; and a second capacitor having one electrode connected to the third node and an other electrode connected to a data line, and wherein the organic light emitting diode comprises:

an anode electrode connected to the second node; and a cathode electrode connected to a second power source voltage line.

18. The method of claim 17, wherein the aging at least one of the transistors comprises:

aging the first transistor and the second transistor in a first aging period by applying a scan signal having a turn-off level to the scan line to turn off the second transistor, applying a second control signal having the turn-off level to the second control line to turn off the third transistor, and changing a data voltage applied to the data line from the high level to the low level.

19. The method of claim 18, wherein a difference value between the high level and the low level of the data voltage is greater than that between the high level and the low level of the first power source voltage.

20. The method of claim 18, wherein the first aging period comprises:

applying a first control signal having the low level to the first control line, applying the first control signal having the low level to the first power source voltage line, and applying a second power source voltage of the high level to the second power source voltage line, in a first period; and applying the first control signal having the high level to the first control line, applying the first control signal having the high level to the first power source voltage line, and applying the second power source voltage having the low level to the second power source voltage line, in a second period after the first period.

21. The method of claim 17, wherein the aging period comprises a second aging period, wherein the second aging period comprises:

aging the third transistor by applying a first control signal having the low level to the first control line, applying the first control signal having the low level to the first power source voltage line, and applying a second power source voltage of the high level to the second power source voltage line, in a first period in a first period; and aging the first transistor and the third transistor by applying a first control signal of the high level to the first control line, applying the first control signal having the high level to the first power source voltage line, and applying the second power source voltage having the low level to the second power source voltage line, in a second period after the first period.

22. The method of claim 21, wherein in the second period, a difference value between the high level and the low level of a data voltage is smaller than that between the high level and the low level of the first power source voltage.

23. The method of claim 21, wherein the aging period further comprises a third aging period, wherein a third period before the second period comprises:

applying a scan signal having a turn-on level to a plurality of scan lines connected to the plurality of pixels, and applying a data signal of high level to a plurality of data lines connected to the plurality of pixels.

24. The method of claim 23, wherein in the third period, scan signals having the turn-on level are concurrently applied to the plurality of scan lines.

25. The method of claim 17, further comprising:

applying a first control signal having the low level to the first control line in an on-bias period;

applying the first power source voltage of a low level to the first power source voltage line, applying the first control signal having the low level to the first control line, applying a second control signal having a turn-on level to the second control line, and applying a scan signal having a turn-off level to the scan line, in a first initialization period;

applying the first power source voltage of the low level to the first power source voltage line, applying the first control signal having the high level to the first control line, applying a second control signal having the turn-on level to the second control line, and applying a scan signal having the turn-on level to the scan line, in a second initialization period; and applying the first power source voltage of the high level to the first power source voltage line, applying the first control signal having the high level to the first control line, applying a second control signal having the turn-on level to the second control line, and applying a scan signal having the turn-on level to the scan line, in a compensation period, wherein the on-bias period, the first initialization period, the second initialization period, the compensation period, and the aging period are sequentially performed.

* * * * *